US005379499A

United States Patent [19]

Jackson

[11] Patent Number: 5,379,499

[45] Date of Patent: Jan. 10, 1995

[54] CREMATION URN

[76] Inventor: Robert L. Jackson, 545 University Pkwy., Aiken, S.C. 29801

[21] Appl. No.: 126,253

[22] Filed: Sep. 22, 1993

[51] Int. Cl.[6] ..... A61G 17/08

[52] U.S. Cl. ..... 27/1; 27/2; 27/35; 220/521

[58] Field of Search ..... 27/1, 2, 35; 220/521, 220/522

[56] References Cited

U.S. PATENT DOCUMENTS

| | | | |
|---|---|---|---|
| 928,033 | 7/1909 | Drouilly | 220/522 |
| 1,030,325 | 6/1912 | Peoples et al. | 220/521 |
| 1,199,593 | 9/1916 | Müller | 220/521 |
| 1,806,256 | 5/1931 | Guenard | 215/227 |
| 2,235,617 | 3/1941 | Klinzing | 27/1 |
| 2,385,520 | 9/1945 | Klinzing | 27/1 |
| 2,412,833 | 12/1946 | Prager | 220/522 |
| 3,047,199 | 7/1962 | McBain | 220/521 |
| 3,581,927 | 6/1971 | Langdon | 220/521 |
| 3,732,602 | 5/1973 | Vigh | 27/1 |
| 4,065,336 | 12/1977 | Conklin | 220/522 |
| 4,091,953 | 5/1978 | Daenen | 220/521 |
| 4,324,026 | 4/1982 | Craft | 27/1 |
| 4,601,403 | 7/1986 | Pollitz | 220/521 |
| 4,724,855 | 2/1988 | Jackson et al. | 220/521 |
| 5,029,373 | 7/1991 | Raymond | 27/1 |

*Primary Examiner*—Carl D. Friedman
*Assistant Examiner*—Kien T. Nguyen
*Attorney, Agent, or Firm*—Michael A. Mann

[57] ABSTRACT

A cremation urn having a first container adapted for receiving the cremated remains of a deceased person, and a second, concealed container for storing memorabilia. The second container serves as the closure for the first, thus, the second container is substantially contained within the first container, inconspicuous but accessible to a user for the purpose of viewing objects contained therein. The second container is closed with a plug that may carry a vase for holding cut flowers, greenery and so forth. Preferably, the urn has identical openings at opposing ends, so that the first container may close either opening and the other opening can be closed by a plug.

20 Claims, 2 Drawing Sheets

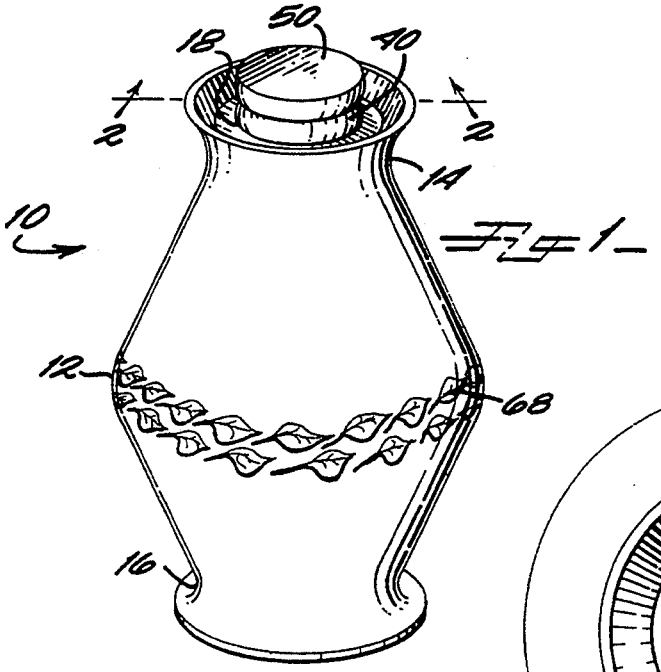
Fig 1
Fig 3
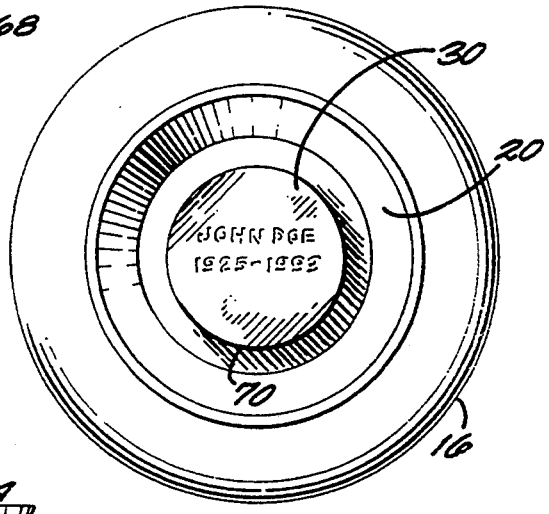
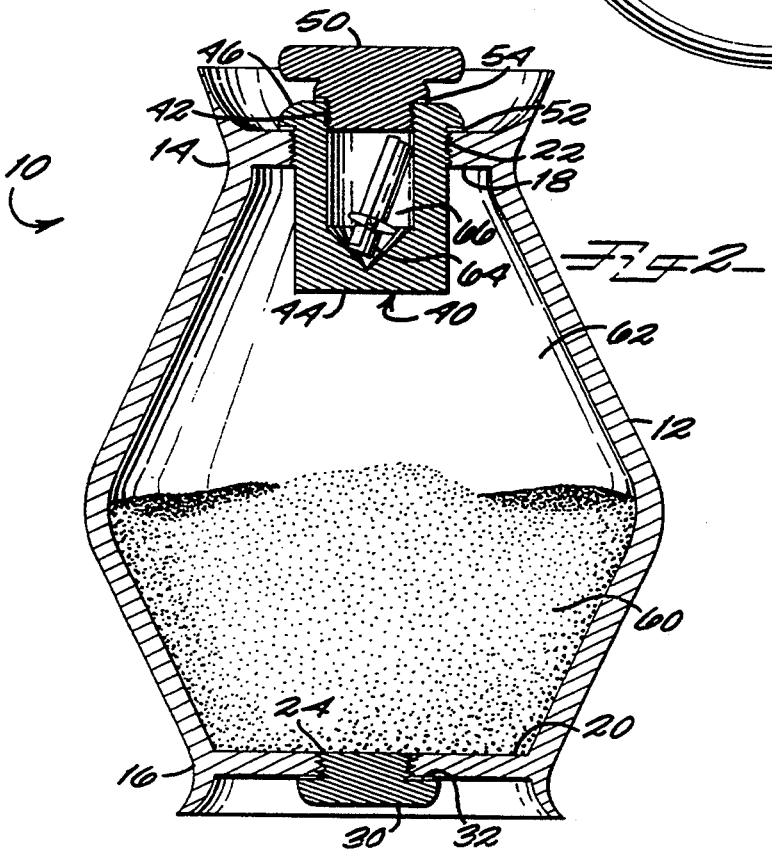
Fig 2

CREMATION URN

BACKGROUND OF THE INVENTION

1. Field of the Invention

The present invention relates to cremation urns. In particular, the present invention relates to a cremation urn having an internal container for holding memorabilia of the deceased.

2. Discussion of Background

Cremation is becoming increasingly accepted as an alternative to burial. Cremated remains are sometimes scattered at a site that is associated with the deceased person. More commonly, the remains are stored in a memorial urn fashioned of bronze, marble or some other long-lasting material, and placed in a mausoleum, cemetery plot or the like. Occasionally, a husband and wife may choose to have their remains placed in a single urn.

Various types of cremation urns are available, including a combination urn and vase (Raymond, U.S. Pat. No. 5,029,373); an urn that degrades when submersed in water so that its contents may be recycled (Vigh, U.S. Pat. No. 3,732,602); a non-corroding porcelain-covered sheet metal urn (Klinzing, U.S. Pat. No. 2,385,520); and an urn that can be hermetically sealed and then reopened and resealed (Klinzing, U.S. Pat. No. 2,235,617).

Craft (U.S. Pat. No. 4,324,026) provides an urn having a compartment for storing cremated remains, and a pull-out drawer for storing small objects. The drawer may be opened without disturbing the remains out of curiosity. If valuables, such as wedding rings, are kept inside, theft is possible.

In other types of containers, compound containers—containers within containers—are known. Prager (U.S. Pat. No. 2,412,833) provides a device that attaches a smaller bottle to a larger bottle. The smaller bottle is screwed into the device, which in turn is screwed onto the exterior threads of a larger bottle. Drouilly (U.S. Pat. No. 928,033) shows an auxiliary receptacle that is threadably received inside a main receptacle, and is itself sealed by a cap. The bottle closure device of Guenard (U.S. Pat. No. 1,806,256) is designed for concealing a token or prize as part of a promotion. Jars may be provided with additional, frictionally retained lids for holding printed matter such as instructions for use of the contents (Rowbotham, U.S. Pat. No. 1,879,517). None of these devices stores cremated remains in one container and other objects in a concealed, resealable second container.

There is a need for a cremation urn which is easily sealed, which may be opened and resealed if needed, and which has a concealed, separate container for storing memorabilia of the deceased.

SUMMARY OF THE INVENTION

According to its major aspects and broadly stated, a cremation urn according to a preferred embodiment of the present invention includes a first container having an opening dimensioned for storing the cremated remains of a deceased person, a second container dimensioned to be received in and adapted to seal the opening of the first container, and a plug for sealing the second container. The second container is suited for containing memorabilia. The bottom of the first container has another opening and a corresponding plug, interchangeable with the second container in the event the user desires to change the orientation of the urn.

In use, the second container is threaded within the opening of the first container and its plug threaded to it. To the casual observer, it appears that the plug of the second container is simply the plug that seals the first container, namely, the urn itself. The inconspicuousness of the second container reduces the chance of theft or vandalism of its contents.

An important feature of the present invention is the second container. The second container serves two functions: it seals the first container that houses the remains, and it acts as a container for memorabilia such as small objects that surviving family members and friends may wish to view from time to time. Because the second container seals the first container, the remains stored in the first container are not disturbed when the second container is opened.

The closure plug and its cooperation with the second container is a very important feature of the present invention. The closure plug, of course, seals the second container. But, importantly, the rim of the closure plug and the rim of the second container have a combined visual appearance that makes them seem to be a unit and that therefore unscrewing the plug will unseal the first container, and yet they are separably operable. This appearance is achieved by having the top of the second container and the plug in adjacent relationship and the plug covering at least the upper surface of the top of the second container. In adjacent relationship, the illusion of unity is most easily achieved. In the present invention, the use of two stacked, identically curved disks creates this illusion of unity, enables easy, independent operation of the plug and second container, and hides in the recess between the disks the joint between them. By using its closure plug to hide the second container by making it appear to be the closure plug of the urn itself, the present design uses the natural fear of the morbid, namely the cremated remains, to thwart the idly curious and the would-be thief.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 1 is a perspective view of an urn according to a preferred embodiment of the present invention;

FIG. 2 is a cross-sectional view of the urn of FIG. 1, at line 2—2 of FIG. 1;

FIG. 3 is an end view of the urn of FIG. 1; and

DETAILED DESCRIPTION OF A PREFERRED EMBODIMENT

Figure 4:
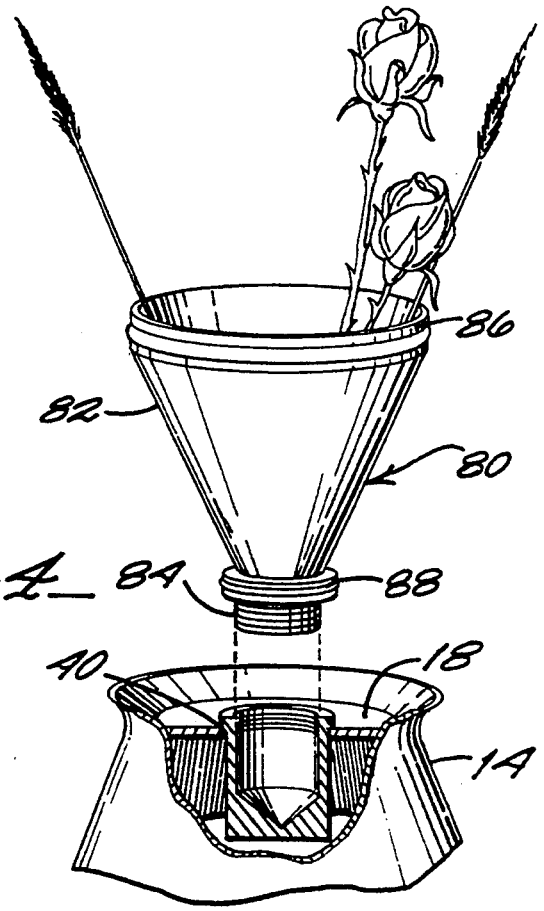
FIG. 4 is an exploded, cut-away view of an urn according to another preferred embodiment of the present invention.

In the following description, similar components are referred to by the same reference numeral in order to simplify the understanding of the sequential aspect of the drawings.

Referring now to FIG. 1, there is shown a perspective view of a preferred embodiment of the present invention. A cremation urn 10 includes a first container 12 with an outwardly flanged neck portion 14 and an outwardly flanged base portion 16. Neck 14 is provided with a flange 18 at the top; base 16 has a flange 20 at the bottom (FIG. 2). Flanges 18, 20 have threaded openings 22, 24, respectively, formed therethrough. Openings 22, 24 preferably have the same diameter, and carry internal threads having the same pitch and depth so that they can be sealed with the same or equivalent closures.

A first threaded plug 30 is screwed into opening 24 to close the opening. If desired, a gasket 32 may be positioned between wall 20 and plug 30. Plug 30 may be screwed securely into either of openings 22, 24.

A second container 40 has an open upper end 42, a closed lower end 44, and a flange 46 at open end 42. Container 40 is threaded as shown in FIG. 2. The outer surface of container 40 is threaded near upper end 42 just below flange 46 so that second container 40 can be screwed into either of openings 22, 24 of first container 12, whereby either opening would be sealed and the bulk of second container 40 would be inside first container 12. The inner surface of upper end 42 is threaded to accept a second threaded plug 50. Gaskets 52, 54 may be placed between flange 46 and flange 18, and between flange 46 and plug 50, respectively.

Thus, urn 10 is provided with three closures: a first closing means (second container 40) for closing opening 22 or opening 24 of first container 12; a second closing means (plug 50) for closing second container 40; and a third closing means (plug 30) for closing-opening 22 or opening 24.

In use, plug 30 is screwed into opening 24 of flange 20. The cremated remains of a deceased person, represented as ashes 60, are placed into first container 12, and second container 40 is screwed into opening 22 of flange 18, sealing ashes 60 in the interior of container 12. Plug 30 and container 40 seal openings 22, 24, forming a secure, closed chamber 62 for permanent storage of ashes 60.

Objects 64, such as a memorial scroll, small personal items including wedding rings, class rings, medals, religious symbols, Masonic insignia, photographs, etc. are placed into second container 40. Objects 64 may include items having sentimental value to the relatives and friends of the deceased person, as well as items having monetary value. Second plug 50 is screwed into end 42 to conceal and protect objects 64. Container 40 and plug 50 form a second closed chamber 66. When container 40 closes opening 22, container 40 is substantially contained within first chamber 62 and is not visible from the outside of urn 10 except for flange 46. The combination of plug 50 and flange 46 of container 40 is perceived by the casual observer as a single, unitary closure and the designs of plug 50 and flange 46 can be adjusted to further camouflage the two-part construction. In the design as illustrated, flange 46 is turned to mirror the top of plug 50, creating two, stacked disks, thereby making it difficult to see that the two are not integral, but making it easy to operate both independently. Other shapes are possible that have the equivalent effect; the important factors are: that (1) the top of plug 50 and the top of second container 40 be in adjacent relationship so that the two will be associated; (2) that the joint between them be hidden by recessing it; (3) that the two have a consistent appearance or profile meaning that they are made of the same materials and shaped, profiled and finished in the same fashion; and (4) that plug 50 operate independently of container 40. Container 40's top and plug 50 must appear to be one closure device, yet operate independently to those who know they are not one closure. The idly curious or vandals will freely open a conspicuous storage compartment such as a door or a drawer in a search for valuables, but are less inclined to open the cremation urn itself. Therefore, the inconspicuousness of chamber 66 reduces the chance of theft of its contents.

Plug 50 may be unscrewed to gain access to objects (64, for example, to view objects 64, or to add or remove objects from chamber 66. Ashes 60 are not disturbed when plug 50 is unscrewed, because opening 18 is closed by container 40. If desired, however, container 40 or plug 30 may be unscrewed from openings 22, 24, respectively, to gain access to first chamber 62. Access may be needed to place the remains of another deceased person into urn 10, or to transfer the contents of the urn to another receptacle.

Container 12 may have any desired, aesthetic shape, including the generally curved shape with outwardly flanged portions 14, 16 shown in FIGS. 1 and 2. Flanges 18, 20 are preferably recessed to conceal plug 30 and provide more stability for urn 10. However, portions 14 and 16 may be straight or inwardly flared rather than outwardly flared as shown, and container 12 may assume other shapes such as a cylinder, pedestal, obelisk and so forth.

As noted above, first plug 30 and second container 40 are threadably received by either of openings 22, 24. Therefore, either portion 14 or portion 16 may be uppermost, with the other portion serving as a base, as preferred by the user. If desired, second container 40 may be dimensioned so that open end 42 has the same diameter, and carries internal threads of the same pitch and depth as openings 22, 24 of first container 12. Then, either of plugs 30, 50 can be screwed into any of openings 22, 24, 42. Plugs 30, 50 may have some other type of closure, such as snap closures or press-fitted closures, however, screw-type plugs are preferred for security and durability.

The outer surface of container 12 may carry decorations 68, such as designs, religious scenes or symbols, or personal scenes. By way of example, designs may be etched, engraved, stamped, printed onto, or applied by decals to the outer surface of container 12. Container 12 may be provided with means for holding photographs, plates bearing identifying data, and the like. Plug 30 (or plug 50) may have a plate 70 attached thereto, engraved or stamped with identifying data (FIG. 3).

Urn 10 is dimensioned so that chamber 62 is large enough to hold a container 40 of the desired size as well as the cremated remains of at least one deceased person. For example, container 12 may be approximately 8" (about 20 cm) in diameter and 12" (about 30 cm) high, and container 40 may be approximately 2" (about 5 cm) in diameter and 4"–6" (about 10–15 cm) high. However, containers 12 and 40 may have any desired dimensions.

Urn 10 is made of any convenient materials, preferably durable, aesthetically pleasing materials. Container 12 may be of stainless steel, bronze, brass, copper, aluminum, plated metal, stone (marble, granite, alabaster, etc.) and the like. Container 40 and plugs 30, 50 may be machined of standard metal stock, preferably bronze, brass, stainless steel or aluminum.

Referring now to FIG. 4, there is shown another preferred embodiment of the present invention. Here, plug 50 is replaced with a vase 80 for holding small plants, cut flowers, greenery and the like. Vase 80 has an open container 82 and a threaded base 84. Base 84 is threaded so that it can be screwed into open end 42 of container 40, and, preferably, into openings 22 and 24 of container 12. Thus, vase 80 is interchangeable with plug 50. Vase 80 can easily be removed for replacing water or flowers, accessing chamber 66, etc. Like first container 12, vase 80 may carry any desired decoration, including ornamental rings 86, 88. However, like above-described plug 50, the appearance of vase 80 does not suggest to the casual observer that urn 10 might contain valuables.

Like containers 12 and 40, vase 80 is made of some durable material such as metal, marble or granite, and so forth. If desired, vase 80 may be made of a combination of materials, such as a metal base 84 and a marble container 82. Vase 80 has any desired shape and dimensions, preferably such that the combination of vase 80 and container 12 has an aesthetically pleasing effect. For example, for a container 12 approximately 12" (about 30 cm) high, vase 80 may be approximately 4" (about 10 cm) high.

It will be apparent to those skilled in the art that many changes and substitutions can be made to the preferred embodiment herein described without departing from the spirit and scope of the present invention as defined by the appended claims.

What is claimed is:

1. A cremation urn, comprising:

a first container adapted for storing cremated remains, said first container having a first end, an opposing second end, a first opening in said first end and a second opening in said second end;

a second container having an opening, said second container having first closing means formed thereon for closing said first opening so that, when said first closing means closes said first opening, said second container is substantially within said first container, said opening being accessible to a user, and said cremated remains are sealed in said first container; second closing means for closing said opening of said second container, said second and said first closing means having a joint therebetween and being in adjacent relationship so that said joint is concealed.

2. The urn as recited in claim 1, wherein said first closing means is adapted for closing either of said first and said second openings.

3. The urn as recited in claim 1, further comprising third closing means for closing said second opening, said third closing means adapted for closing either of said first and said second openings.

4. The urn as recited in claim 1, said first closing means adapted for closing either of said first and said second openings, further comprising third closing means for closing said second opening, said third closing means adapted for closing either of said first and said second openings.

5. The urn as recited in claim 1, wherein said first opening has internal threads, and wherein said first closing means further comprises a plug having external threads cooperable with said threads of said first opening, said plug having said second container formed therein.

6. The urn as recited in claim 1, wherein said first container has a second opening in said second end, said second opening having internal threads, further comprising a plug having external threads cooperable with the threads of said second opening.

7. The urn as recited in claim 1, wherein said opening in said second container is threaded, and wherein said second closing means further comprises a plug having external threads cooperable with the threads of said opening.

8. The urn as recited in claim 1, wherein said second closing means has a third container formed therein, said third container being accessible to a user when said second closing means closes said second container.

9. A cremation urn, comprising:

a first container adapted for storing cremated remains, said first container having an interior, a first end and an opposing second end, a first threaded opening in said first end and a second threaded opening in said second end;

a second container having an interior, a first end and an opposing second end, and a threaded opening in said first end, said first end of said second container threadably closing said first opening of said first container so that, when said second container closes said first opening, said second container is substantially within said first container, said cremated remains are sealed in said first container, and said opening of said second container is accessible to a user; and a first threaded plug for closing said opening of said second container, said first end of said second container and said first threaded plug being in adjacent relationship.

10. The urn as recited in claim 9, wherein said first end of said second container being adapted for threadably closing either of said first and said second openings.

11. The urn as recited in claim 9, further comprising a second threaded plug for closing said second opening, said second plug adapted for closing either of said first and said second openings.

12. The urn as recited in claim 9, wherein said first end of said second container is adapted for closing either of said first and said second openings, further comprising a second threaded plug for closing said second opening, said second plug adapted for closing said first opening of said first container and said opening of said second container.

13. The urn as recited in claim 9, wherein said first threaded plug has a third container formed therein, said third container being accessible to a user when said first plug closes said opening of said second container.

14. The urn as recited in claim 9, wherein said first container is made of a material selected from the group consisting essentially of bronze, brass, stainless steel, copper, aluminum, stone and combinations thereof.

15. The urn as recited in claim 9, wherein said second container is made of a material selected from the group consisting essentially of bronze, brass, stainless steel and aluminum.

16. A cremation urn, comprising:

a hollow body dimensioned for receiving the cremated remains of at least one deceased human, said hollow body having an interior, a first end, an opposing second end, a first opening formed in said first end and a second opening formed in said second end;

a hollow container dimensioned to fit into said opening so as to seal said first opening, said hollow container having a flange engaging said first end of said hollow body;

a plug for sealing said hollow container, said plug and said hollow container having a joint therebetween, said plug and said hollow container cooperating to conceal said joint so that said plug and said hollow container appear to seal said hollow body as a unit.

17. The cremation urn as recited in claim 16, wherein said plug is dimensioned to cover said flange of said hollow container.

18. The cremation urn as recited in claim 16, wherein said plug has a top with a first profile and said flange has a second profile, and said first and said second profiles are the same.

19. The cremation urn as recited in claim 16, wherein said plug and said hollow container are made of the same material so that said plug and said hollow container appear to be integrally attached.

20. The cremation urn as recited in claim 16, wherein said plug covers said flange and has a top with a first profile and said flange has a second profile, and said first and said second profiles are the same.

* * * * *